United States Patent [19]

Kohm

[11] Patent Number: 5,016,148

[45] Date of Patent: May 14, 1991

[54] FLASHLIGHT BATON APPARATUS

[76] Inventor: Blane D. Kohm, 832 Edgemont, Perryville, Mo. 63775

[21] Appl. No.: 486,613

[22] Filed: Feb. 28, 1990

[51] Int. Cl.[5] ..... A45B 3/02

[52] U.S. Cl. ..... 362/102; 362/208; 362/109; 16/114 R; 74/551.9

[58] Field of Search ..... 362/102, 109, 119, 120, 362/157, 208; 16/111 R, 114 R, 116 R; 74/DIG. 12, 551.9

[56] References Cited

U.S. PATENT DOCUMENTS

| | | | |
|---|---|---|---|
| 1,235,309 | 7/1917 | Garretson | 16/114 R |
| 3,981,043 | 9/1976 | Curry | 16/114 R |
| 4,415,954 | 11/1983 | Schaefer | 74/551.9 |
| 4,479,171 | 10/1984 | Mains | 362/102 |
| 4,754,379 | 6/1988 | Icelley | 362/202 |
| 4,819,137 | 4/1989 | Hamilton | 362/102 |

*Primary Examiner*—Stephen F. Husar
*Assistant Examiner*—D. M. Cox
*Attorney, Agent, or Firm*—Leon Gilden

[57] ABSTRACT

A flashlight defined by an elongate, cylindrical body threadably receiving a series of fasteners directed through semi-cylindrical shells. The semi-cylindrical shells are of a resilient construction to absorb shock directed through the flashlight during use of the flashlight as a defensive or offensive weapon. A modification of the instant invention includes the shell structure formed with through-extending, coaxially parallel bores receiving cylindrical rods to provide varied weighting of the shell structure.

6 Claims, 5 Drawing Sheets

FLASHLIGHT BATON APPARATUS

BACKGROUND OF THE INVENTION

1. Field of the Invention

The field of invention relates to baton apparatus, and more particularly pertains to a new and improved flashlight baton apparatus wherein the same utilizes shock absorbing shell structure mounted to a flashlight to provide a weapon of enhanced use and balance.

2. Description of the Prior Art

Flashlights are utilized typically by law enforcement agenices and the like as illuminating members, as well as a weapon. The flashlight construction formed of a metallic structure typically directs vibration and the like through the flashlight to a user. To minimize this effect, the instant invention includes a shell structure to overcome deficiencies of the prior art to absorb such shock. Examples of the prior art include U.S. Pat. No. 4,819,137 to Hamilton wherein a telescopingly elongate organization includes a ring structure to provide a self-defense baton.

U.S. Pat. No. 4,479,171 to Manis provides a flashlight structure wherein a handle member is directed orthogonally relative to the axis of the flashlight, wherein the switch of the flashlight is mounted within a terminal end of the handle member.

U.S. Pat. No. 4,600,974 to Lew, et al., provides a decorated baton for use as a toy and in night time application by traffic directing police officials and the like.

U.S. Pat. No. 4,792,883 to Ackerman, et al., provides a runner's baton bat wherein a series of weighted segments have interchangeable compartments for holding various items for use by runners and the like.

U.S. Pat. No. 3,737,649 to Nelson, et al., provides an elongate baton flashlight with a metal housing, with spacer blocks positioned therewithin to form a circuit through which current flows.

As such, it may be appreciated that there continuous to be a need for a new and improved flashlight baton apparatus which addresses both the problems of ease of use, as well as effectiveness in construction in providing a flashlight serving a purpose as a baton in a weapons scenario and in this respect, the present invention substantially fulfills this need.

SUMMARY OF THE INVENTION

In view of the foregoing disadvantages inherent in the known types of baton apparatus now present in the prior art, the present invention provides a flashlight baton apparatus wherein the same utilizes vibration absorbing shell structure to minimize the vibration directed through the flashlight housing in use as a weapon. As such, the general purpose of the present invention, which will be described subsequently in greater detail, is to provide a new and improved flashlight baton apparatus which has all the advantages of the prior art baton apparatus and none of the disavantages.

To attain this, the present invention includes a flashlight defined by an elongate, cylindrical body threadably receiving a series of fasteners direction through semi-cylindrical shells. The semi-cylindrical shells are of a resilient construction to absorb shock directed through the flashlight during use of the flashlight as a defensive or offensive weaspon. A modification of the instant invention includes the shell structure formed with through-extending, coaxially parallel bores receiving cylindrical rods to provide varied weighting of the shell structure.

My invention resides not in any one of these features per se, but rather in the particular combination of all of them herein disclosed and claimed and it distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structure, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flashlight baton apparatus which has all the advantages of the prior art baton apparatus and none of the disadvantages.

It is another object of the present invention to provide a new and improved flashlight baton apparatus which may be easily and efficiently manufactured and marketed.

It is a further object of the present invention to provide a new and improved flashlight baton apparatus which is of a durable and reliable construction.

An even further object of the present invention is to provide a new and improved flashlight baton apparatus which is susceptible of a low cost of manufacture with regard to both materials and labor, and which accordingly is then susceptible of low prices of sale to the consuming public, thereby making such flashlight baton apparatus economically available to the buying public.

Still yet another object of the present invention is to provide a new and improved flashlight baton apparatus which provided in the apparatuses and methods of the prior art some of the advantages thereof, while simultaneously overcoming some of the disadvantages normally associated therewith.

Still another object of the present invention is to provide a new and impoved flashlight baton appartus wherein the same utilizes shock absorbing shell structure to minimize vibration directed through the associated flashlight to an individual's hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
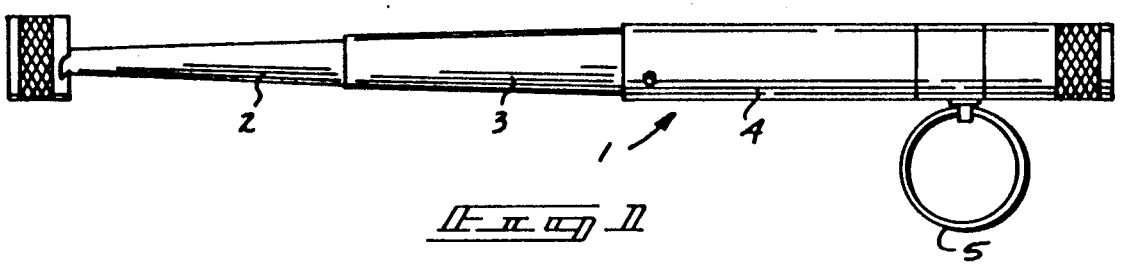
FIG. 1 PRIOR ART
FIG. 1 is an orthographic side view of a prior art baton apparatus.

With reference now to the drawings, and in particular to FIGS. 1 to 11 thereof, a new and improved flashlight baton apparatus embodying the principles and concepts of the present invention and generally designated by the reference numeral 10 will be described.

Figure 2:
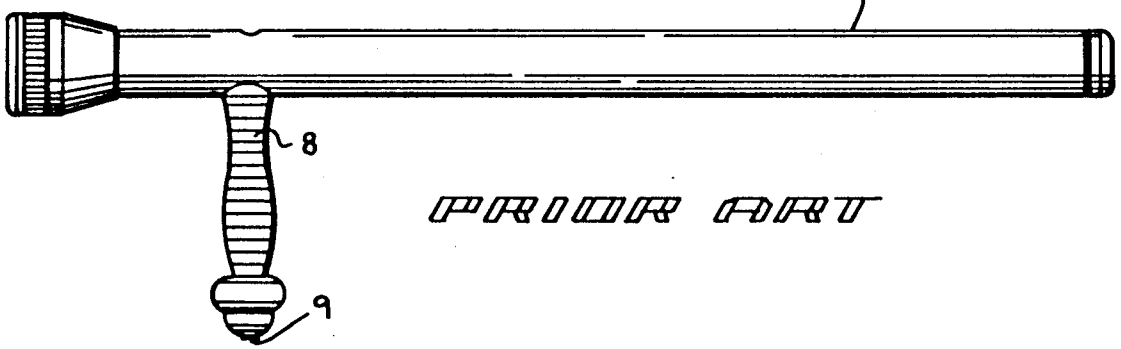
FIG. 2 PRIOR ART
FIG. 2 is an orthographic side view of a further prior art baton apparatus.

FIG. 1 illustrates a prior art baton structure 1 wherein a series of first, second, and third respective housings 2, 3, and 4 are telescopingly mounted relative to one another, with a ring 5 mounted to the third housing 5 to enhance manual grasping of the organization. FIG. 2 illustrates a further proir art baton apparatus 6 wherein a flashlight 7 includes a handle 8 directed orthogonally thereto, with a switch 9 mounted a remote terminal end of the handle 8.

More specifically, the flashlight baton apparatus 10 of the instant invention essentially comprises a longitudinally aligned cylindrical flashlight body 11 mounting an enlarged illuminated head member 12 coaxially and aligned therewith. A switch 13 mounted on the flashlight body 11 adjacent the head member 12 permits selective actuation of the illumination member. The apparatus further includes a plurality of semi-cylindrical resilient shells 14 including a convex interior surface 15 defined by a complementary configuration to that of the flashlight body 11. Counter-sunk bores 16 orthogonally directed to the axis of the shells 14 and of the flashlight 11 receive fasteners 17 therethrough that are threadably received within threaded bores formed within the body 11.

Figure 5:
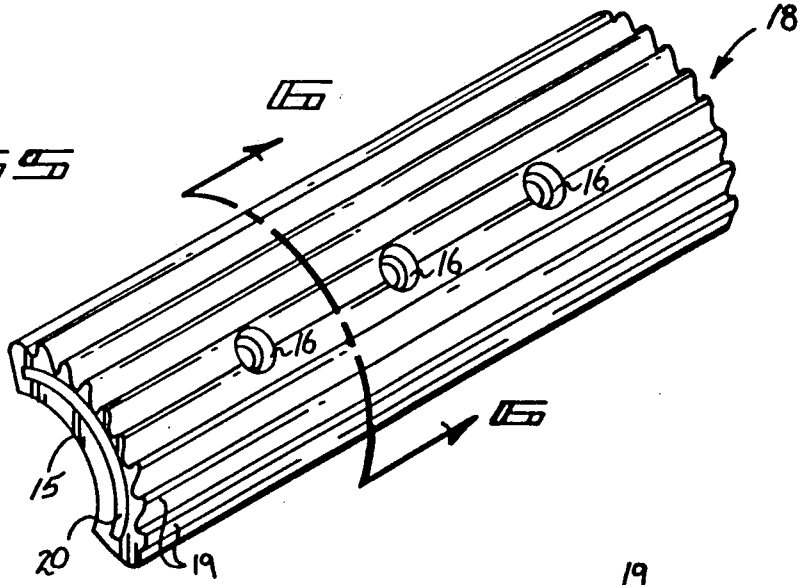
FIG. 5 is an isometric illustration of a modified shell structure utilized by the instant invention.
Figure 6:
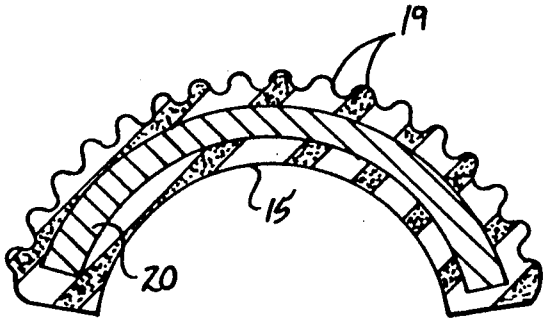
FIG. 6 is an orthographic view, taken along the lines 6—6 of FIG. 5 in the direction indicated by the arrows.

FIG. 5 illustrates a modified shell 18 for use in replacement of the shell structure 14, wherein the modified shell 18 includes a ribbed exterior surface defined by parallel ribs 19 arranged parallel an axis defined by the shell structure 18 and of the associated flashlight body 11. A weighted metallic insert 20 is imbedded within the shell 18 to enhance balance and weighting of the organization in use.

Figures 3, 4:
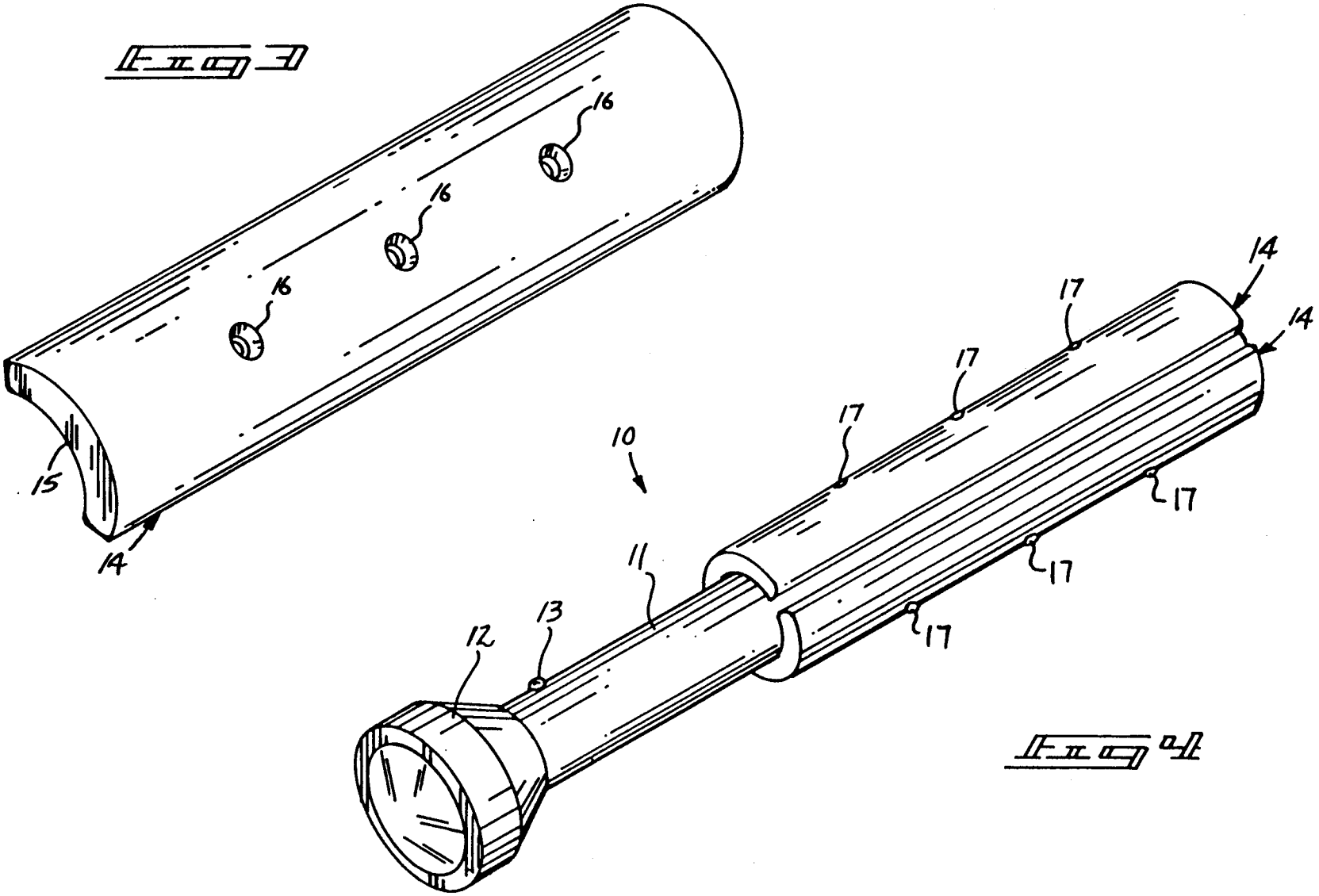
FIG. 3 is an isometric illustration of a shell structure utilized by the instant invention.
FIG. 4 is an isometrc illustration of the instant invention.
Figure 7:
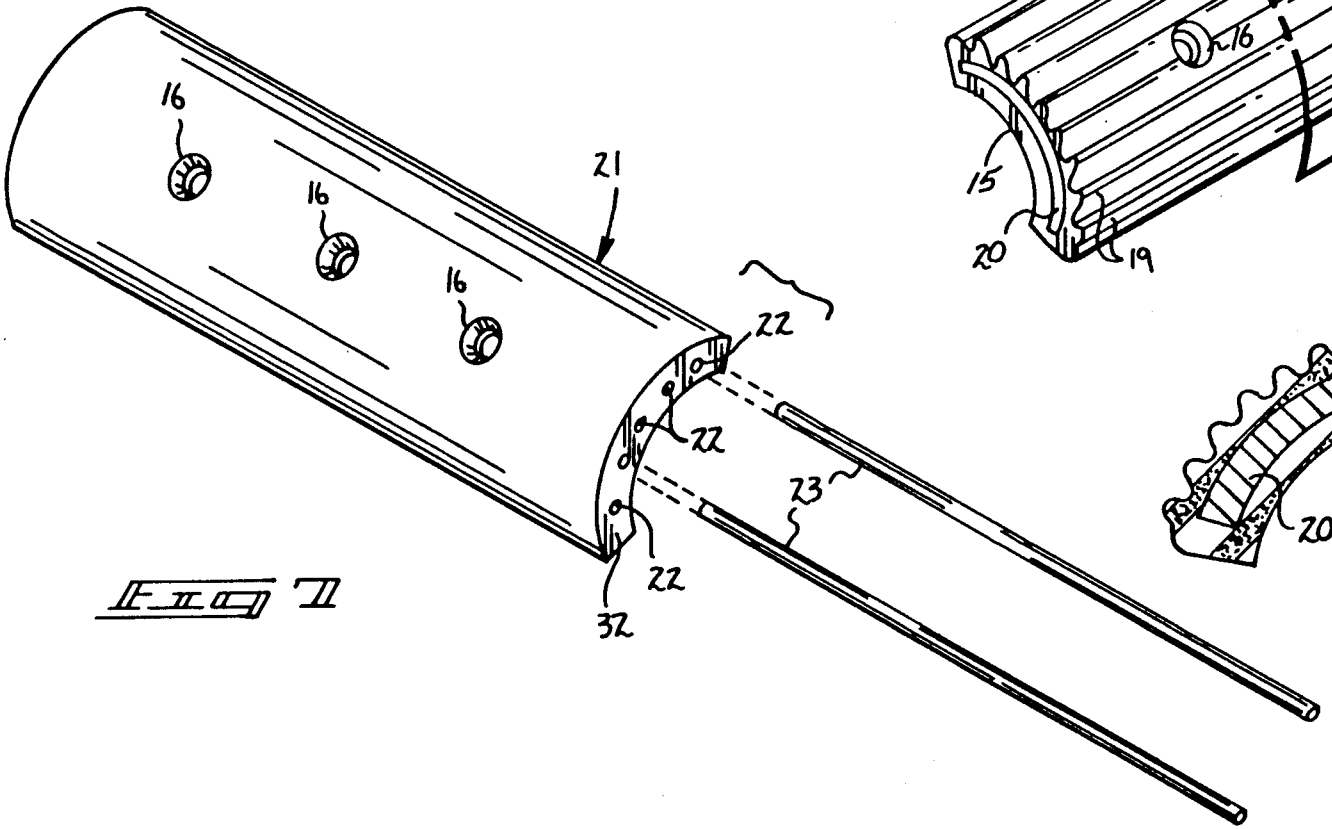
FIG. 7 is an isometric illustration of a yet further modified shell structure.

FIG. 7 illustrates a further modified semi-cylindrical shell structure 21 wherein in lieu of the single weighted insert 20, a series of metallic weighted rods 23 are selectively insertable within cylindrical bores 22. The bores 22 are of a complementary configuration to receive the rods 23 therewithin. In this manner, an individual may selectively weight the shells 21 in a desired manner. The bores 22 are arranged parallel to one another and to an axis defined by the shell structure 21 and of the associated flashlight 11 receiving the further modified shell structure 21, utilizing the fastener 17 in a manner as illustrated in FIG. 4.

Figures 8, 9:
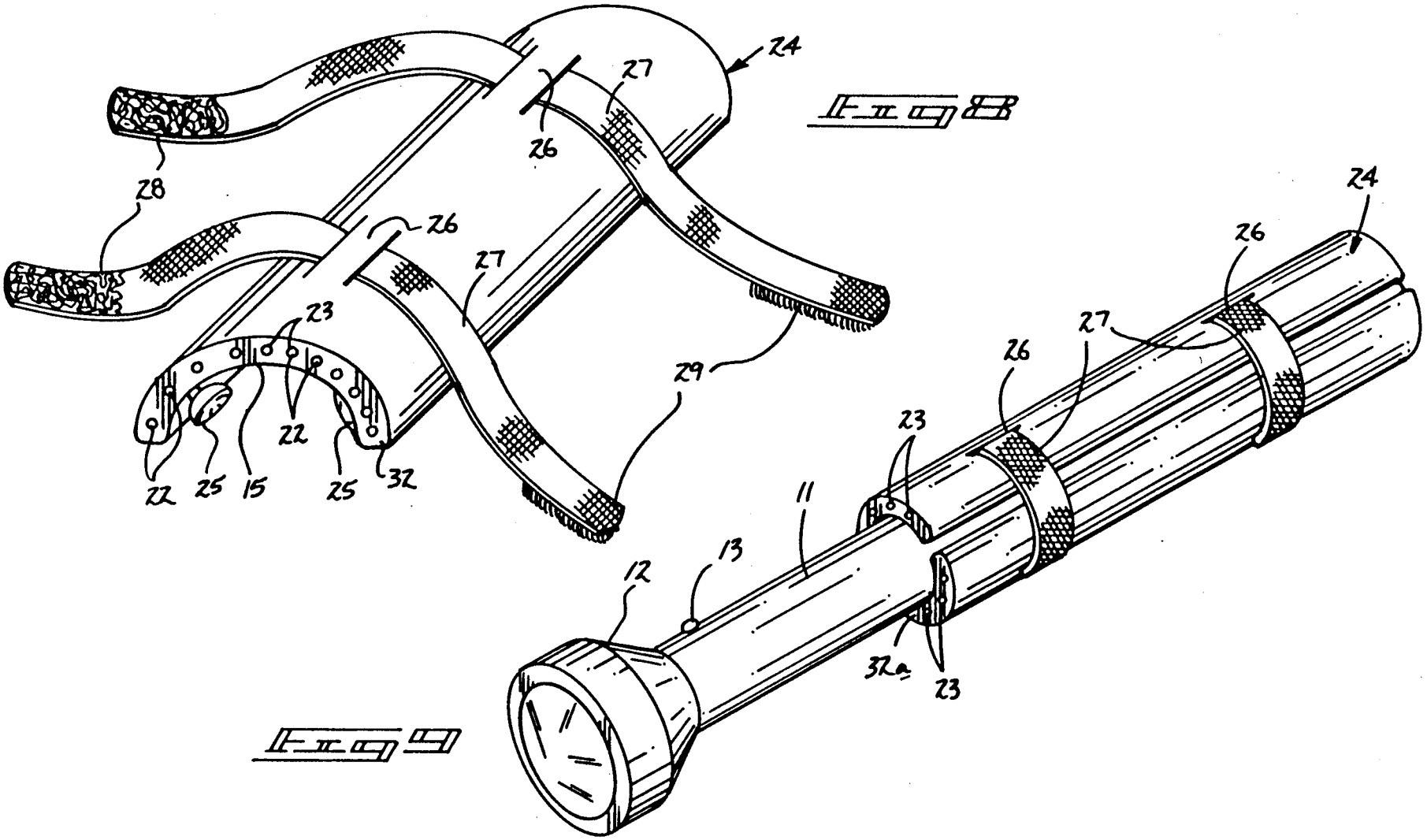
FIG. 8 is an isometric illustration of a shell structure utilized by the instant invention incorporating strap and suction cup securement members to mount the shell structure to an associated flashlight.
FIG. 9 is an isometric illustration of the shell structure of FIG. 8 mounted to an associated flashlight.
Figure 10:
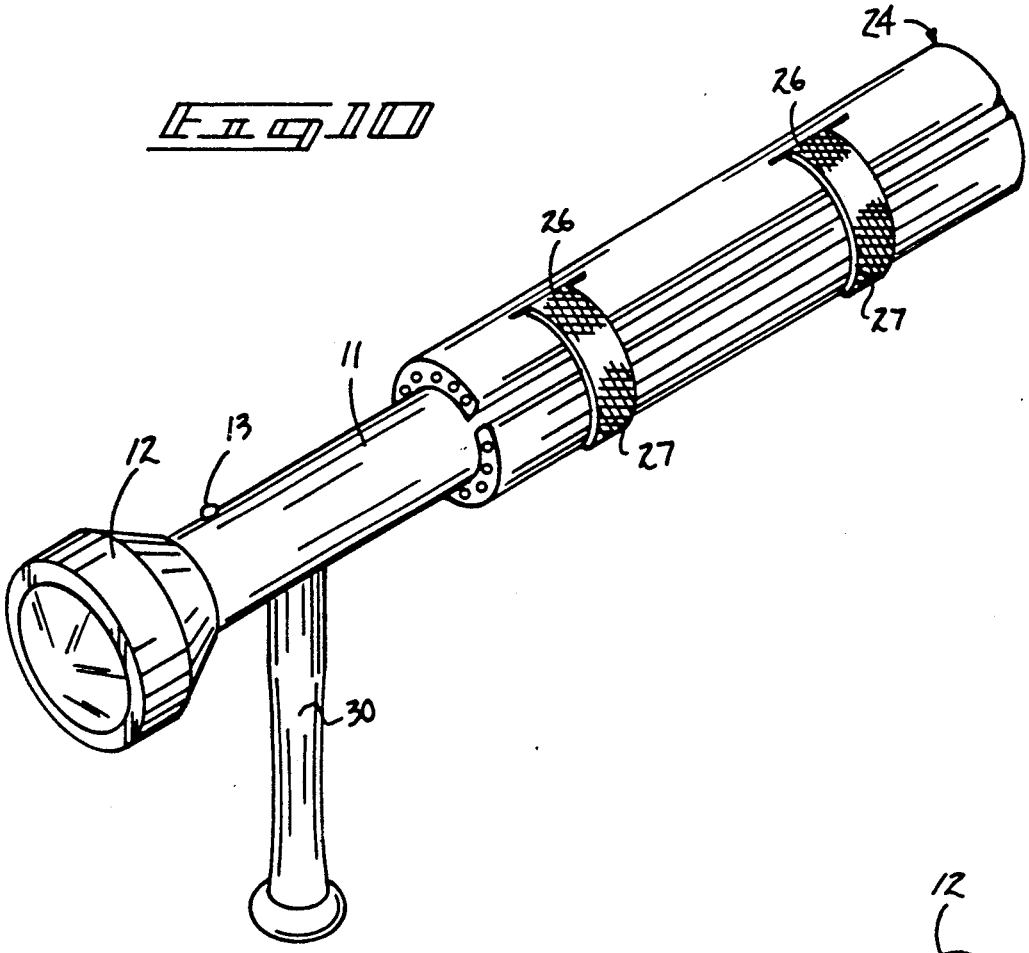
FIG. 10 is an isometric illustration of the shell structure of FIG. 8 mounted to a modified flashlight.
Figure 11:
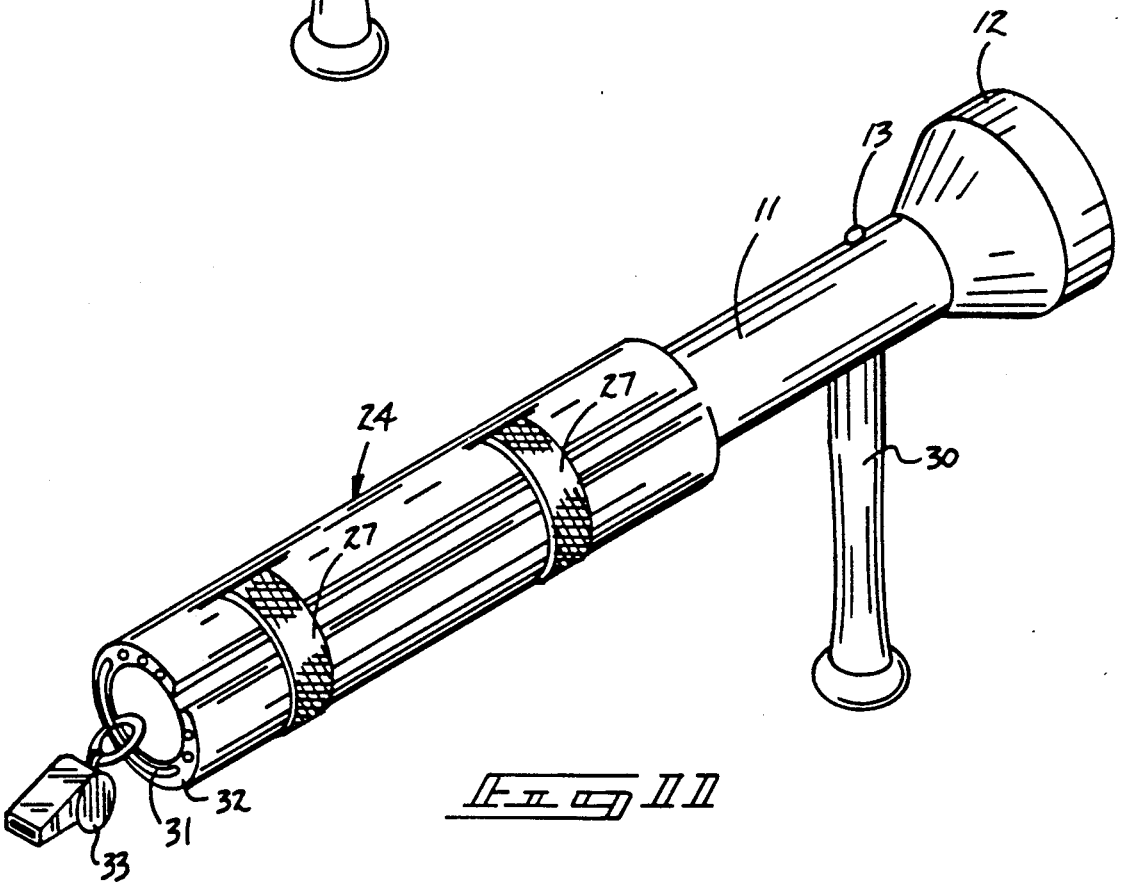
FIG. 11 is an isometric rear view of the shell structure of FIG. 8 mounted to the modified flashlight, as illustrated in FIG. 10.

FIGS. 8 through 11 illustrate a yet further modified cylindrical shell structure 24 employing a series of suction cups 25 mounted to the convex interior surface thereof, as well as the metallic rods 23 selectively receivable within cylindrical bores 22. Further, spaced cover loops 26 are aligned parallel to the rods 23, as well as the axis of the shell 24, to receive flexible straps 27 therethrough. The flexible straps 27 are accordingly arranged parallel to one another, wherein each includes a first hook and loop fastener patch 28 mounted to a forward terminal end of each strap 27 to an exterior surface thereof. A second hook and loop fastener patch 29 is mounted to an interior at a further terminal end of each of the straps 27 to permit encompassing of a flashlight body 11 thereabout, as illustrated in FIG. 9. The shell structure 24 is of a generally cylindrical construction, wherein a single shell encompasses the flashlight body 11 permitting the straps 27 to be adjustably secured about the flashlight shell body to accommodate variations in dimensional lengths of the body 11, as well as accommodating variations and resilience of the shell structure 24 dependent upon the number of metallic rods 23 positioned within associated bores 22. FIG. 10 illustrates the shell body 24 mounted to a modified housing 11 that includes a support shaft 30 orthogonally arranged relative to the axis of the body 11. Further, the shell structure 24, as illustrated in FIG. 11, utilizes a diametrically aligned strap 31 secured to a rear end surface 32 of the shell structure 24, with a whistle 33 mounted to the strap 31. It should be noted that the bores 22 extend from a forward suface **32*a* to the end surface 32 of each shell structure 24, and wherein each of the rods 23 secured therewith is clampingly secured therewithin by resilient encompassing of the shell structure 24** thereabout.

As to the manner of usuage and operation of the instant invention, the same should be apparent from the above disclosure, and accordingly no further discussion relative to the manner of usuage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flashlight baton apparatus comprising, in combination, a flashlight including a longitudinally aligned cylindrical flashlight body, including an enlarged illuminated head member axially aligned with the body, and a switch positioned adjacent the head member on the body for selective illumination of the head member, and a resilient shell means for securement to the flashlight body, the shell means defined by an axial length less than that of a predetermined axial length defined by the flashlight body, and the shell means including a convex interior surface complementary to an exterior surface defined by the body, and fastening means for securement of the shell means to the body, and wherein the shell means is defined as a generally resilient shell member defined by cylindrical concave interior surface and a spaced cylindrical convex exterior surface, and the resilient shell further including a series of cylindrical bores directed through the shell, the cylindrical bores arranged parrallel to one another and parallel to an axis defined by the cylindrical shell, and the cylindrical bores defined by a predetermined cylindrical configuration.

2. An apparatus as set forth in claim 1 further including cylindrical metallic rods, the metallic rods defined by a cylindrical external configuration equal to the predetermined cylindrical configuration of the cylindrical bores, and the cylindrical rods receivable within the cylindrical bores.

3. An apparatus as set forth in claim 2 wherein the cylindrical shell further includes a plurality of loops formed to the exterior surface of the cylindrical shell, and the loops coaxially aligned with the cylindrical shell, and each loop including a flexible strap directed therethrough, the flexible straps defining the fastening means.

4. An apparatus as set forth in claim 3 wherein each flexible strap includes a first hoop and loop fastener patch formed to an exterior forward terminal end surface of each flexible strap, and a second hoop and loop fastener patch mounted to an interior forward terminal end surface of each flexible strap, wherein the first and second hook and loop fastener patches are securable to one another for encompassing the cylindrical shell to the flashlight body.

5. An apparatus as set forth in claim 4 wherein the cylindrical shell further includes a diametrically aligned strap mounted to a rear end surface of the cylindrical shell, and the strap further including a whistle member secured to the strap.

6. An apparatus as set forth in claim 5 wherein the flashlight body further includes a handle arranged orthogonally relative to the flashlight body between the head member and the cylindrical shell.

* * * * *